US010246977B2

(12) United States Patent
Xiao et al.

(10) Patent No.: US 10,246,977 B2
(45) Date of Patent: Apr. 2, 2019

(54) ELECTRIC SUBMERSIBLE PUMP WITH ULTRASOUND FOR SOLID BUILDUP REMOVAL

(71) Applicant: Saudi Arabian Oil Company, Dhahran (SA)

(72) Inventors: Jinjiang Xiao, Dhahran (SA); Rafael Adolfo Lastra, Dhahran (SA); Randall Shepler, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 339 days.

(21) Appl. No.: 15/004,304

(22) Filed: Jan. 22, 2016

(65) Prior Publication Data

US 2017/0211366 A1 Jul. 27, 2017

(51) Int. Cl.

| | |
|---|---|
| ***F04D 13/10*** | (2006.01) |
| ***G10K 11/18*** | (2006.01) |
| ***E21B 37/00*** | (2006.01) |
| ***E21B 28/00*** | (2006.01) |
| ***B08B 9/02*** | (2006.01) |
| ***E21B 37/08*** | (2006.01) |
| ***E21B 43/12*** | (2006.01) |

(52) U.S. Cl.

CPC ..... *E21B 43/128* (2013.01); *F04D 13/10* (2013.01)

(58) Field of Classification Search

None

See application file for complete search history.

(56) References Cited

U.S. PATENT DOCUMENTS

| | | | | |
|---|---|---|---|---|
| 5,222,049 | A * | 6/1993 | Drumheller | B06B 1/0611 367/82 |
| 5,727,628 | A * | 3/1998 | Patzner | E21B 28/00 166/177.2 |
| 6,167,965 | B1 * | 1/2001 | Bearden | E21B 43/121 166/105.5 |
| 6,186,228 | B1 | 2/2001 | Wegener et al. | |

(Continued)

FOREIGN PATENT DOCUMENTS

| | | |
|---|---|---|
| WO | 2009133106 A1 | 11/2009 |
| WO | 2015128680 A1 | 9/2015 |
| WO | 2015179775 A1 | 11/2015 |

OTHER PUBLICATIONS

The International Search Report and Written Opinion for related PCT application PCT/US2017/014315 dated Mar. 29, 2017.

*Primary Examiner* — Matthew R Buck
*Assistant Examiner* — Douglas S Wood
(74) *Attorney, Agent, or Firm* — Bracewell LLP; Constance G. Rhebergen; Linda L. Morgan

(57) ABSTRACT

A system for providing artificial lift to wellbore fluids having solid buildup removal capabilities includes a pump submerged in wellbore fluids and in fluid communication with a tubular member extending within a wellbore. The pump is oriented to selectively boost a pressure of the wellbore fluids traveling from the wellbore towards an earth's surface. A motor is located within the wellbore providing power to the pump. A seal assembly has a first side connected to the motor and a second side connected to the pump, wherein the pump, the motor and the seal assembly together form a submersible pump string. An ultrasonic device is connected to the submersible pump string and operable to produce pressure waves.

20 Claims, 3 Drawing Sheets

(56) References Cited

U.S. PATENT DOCUMENTS

| | | | | |
|---|---|---|---|---|
| 6,474,349 | B1 | 11/2002 | Laker | |
| 6,973,972 | B2 * | 12/2005 | Aronstam | E21B 28/00 166/177.2 |
| 8,197,602 | B2 | 6/2012 | Baron et al. | |
| 9,056,338 | B2 | 6/2015 | Bowman | |
| 2013/0277064 | A1 | 10/2013 | Xiao et al. | |
| 2013/0319458 | A1 | 12/2013 | Lim et al. | |
| 2015/0096744 | A1 | 4/2015 | Signorelli et al. | |
| 2015/0138923 | A1 * | 5/2015 | Abernathy | E21B 43/26 367/137 |
| 2016/0070016 | A1 * | 3/2016 | Wang | E21B 47/0007 73/152.28 |

* cited by examiner

ELECTRIC SUBMERSIBLE PUMP WITH ULTRASOUND FOR SOLID BUILDUP REMOVAL

BACKGROUND OF THE DISCLOSURE

1. Field of the Disclosure

The present disclosure relates to electrical submersible pumps used in hydrocarbon development operations, and more specifically, the disclosure relates to electrical submersible pumps with ultrasonic cleaning capability.

2. Description of the Related Art

In hydrocarbon developments, it is common practice to use electric submersible pumping systems (ESPs) as a primary form of artificial lift. A challenge with ESP operations is solid precipitation and deposition on the ESP string, including on the motor housing, pump intake, pump stages such as impellers and diffusers, and pump discharge. Solid compositions can include one or more types of scales, such as CaCO3, CaSO4, SrSO4 CaMg(CO3)2, and corrosion products. Deposition of solids can result in an increase in ESP trips due to motor high temperature and overload. Motor electrical shorts can occur due to scale and corrosion buildup in the pump forcing the motor to work harder and exceed its designed rating. Moreover, as adequate flow of produced fluid past the motor is required for cooling, solids blockage of a pump's flow path and solids build up around the outside of the motor leads to rapid motor internal heat rise, insulation breakdown and electrical short. Some ESP wells cannot restart after a shutdown due to shaft rotation restriction from solids build up between the shaft and radial bearings, therefor requiring a workover to change out the ESP. Continuous chemical injection is often utilized to treat CaCo3 scale in order to increase ESP reliability and run life, but retrofitting existing ESP wells with such a system requires high capital expenditures and an increase in operating expenses, plus the introduction of new safety concerns to unmanned platforms.

SUMMARY OF THE DISCLOSURE

Systems and methods disclosed herein describe an electric submersible pump system that is conveyed downhole with an associated ultrasonic assembly to prevent, remove, or at least reduce solid buildup in the submersible pump string including in the pump intake, the pump stages, and the pump discharge, as well as the outside of the motor and alternative flow paths such as the Y-tool. The ultrasonic assembly can prolong ESP run life and increase hydrocarbon production.

In an embodiment of this disclosure, a system for providing artificial lift to wellbore fluids having solid buildup removal capabilities includes a pump submerged in wellbore fluids and in fluid communication with a tubular member extending within a wellbore. The pump is oriented to selectively boost a pressure of the wellbore fluids traveling from the wellbore towards an earth's surface. A motor is located within the wellbore providing power to the pump. A seal assembly has a first side connected to the motor and a second side connected to the pump, wherein the pump, the motor and the seal assembly together form a submersible pump string. An ultrasonic device is connected to the submersible pump string and is operable to produce pressure waves.

In alternate embodiments, the ultrasonic device includes an ultrasonic generator and an ultrasonic transducer. The ultrasonic transducer can be secured to an outer diameter of the submersible pump string or can be located within an internal space of the submersible pump string. The ultrasonic generator and ultrasonic transducer can be part of an ultrasonic device, the ultrasonic device being connected in series with the submersible pump string. A Y-tool can be connected to the submersible pump string, and the ultrasonic transducer can be integrated with the pump string on the Y-tool.

In other alternate embodiments, a power cable can extend from the earth's surface, be connected to the submersible pump string, and be in electrical connection with the ultrasonic device. The power cable can also be in electrical connection with the motor. Alternately, the system can include a power generator connected to the ultrasonic device, the power generator producing a power supply for the ultrasonic device from a source selected from a group consisting of heat within the wellbore, pressure within the wellbore, and vibration within the wellbore.

In an alternate embodiment of this disclosure, a system for providing artificial lift to wellbore fluids having solid buildup removal capabilities includes a submersible pump string oriented to selectively boost a pressure of the wellbore fluids traveling from a wellbore towards an earth's surface through a tubular member extending within the wellbore. The submersible pump string includes a pump submerged in wellbore fluids within the wellbore, a motor mechanically connected to the pump, and a seal assembly located between the pump and the motor. An ultrasonic generator is connected to the submersible pump string. An ultrasonic transducer is connected to the ultrasonic generator. The ultrasonic transducer is operable to generate pressure waves within the system, selectively bombarding the submersible pump string with ultrasonic cavitation.

In alternate embodiments the ultrasonic transducer can operate with a frequency of 20 kHz to 400 kHz. The ultrasonic transducer can include a network of individual transducers spaced along the submersible pump string. The ultrasonic transducer can be oriented to direct the pressure waves towards one selected from a group consisting of an intake of the pump, a stage of the pump, a discharge of the pump, an outside of the motor, a Y-tool, or a combination thereof. A control system can be in communication with the ultrasonic generator and selectively switching the ultrasonic generator between an operating and non-operating condition.

In yet another alternate embodiment of this disclosure, a method for providing artificial lift to wellbore fluids and solid buildup removal includes providing a pump, a motor for powering the pump, and a seal assembly having a first side connected to the motor and a second side connected to the pump, wherein the pump, the motor and the seal assembly together form a submersible pump string. An ultrasonic generator and ultrasonic transducer are connected to the submersible pump string. The pump is submerged in wellbore fluids to boost a pressure of the wellbore fluids traveling from a wellbore towards an earth's surface through a tubular member extending within the wellbore. An electric pulse is generated with the ultrasonic generator and the electric pulse is provided to the ultrasonic transducer. Pressure waves are directed within the wellbore fluids towards the submersible pump string with the ultrasonic transducer.

In alternate embodiments, the step of connecting the ultrasonic transducer to the submersible pump string can include securing the ultrasonic transducer to an outer diameter of the submersible pump string or securing the ultrasonic transducer to an internal space of the submersible pump string. Alternately, the step of connecting the ultrasonic generator and the ultrasonic transducer to the submersible pump string can include connecting an ultrasonic device in series with the submersible pump string. The step of directing pressure waves within the wellbore fluids towards the submersible pump string with the ultrasonic transducer can include directing pressure waves towards one of a group consisting of an intake of the pump, a stage of the pump, a discharge of the pump, an outside of the motor, a Y-tool, or a combination thereof. A power supply for the ultrasonic generator can be produced with a power generator that produces power from a source selected from a group consisting of heat within the wellbore, pressure within the wellbore, and vibration within the wellbore. Alternately, a power can be provided to the ultrasonic generator with a power cable that extends from the earth's surface, is connected to the submersible pump string, and is in electrical connection with the ultrasonic generator.

BRIEF DESCRIPTION OF THE DRAWINGS

So that the manner in which the above-recited features, aspects and advantages of the embodiments of this disclosure, as well as others that will become apparent, are attained and can be understood in detail, a more particular description of the disclosure briefly summarized above may be had by reference to the embodiments thereof that are illustrated in the drawings that form a part of this specification. It is to be noted, however, that the appended drawings illustrate only preferred embodiments of the disclosure and are, therefore, not to be considered limiting of the disclosure's scope, for the disclosure may admit to other equally effective embodiments.

DETAILED DESCRIPTION

Embodiments of the present disclosure will now be described more fully hereinafter with reference to the accompanying drawings which illustrate embodiments of the disclosure. Systems and methods of this disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments or positions.

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the skills of persons skilled in the relevant art.

Figure 1:
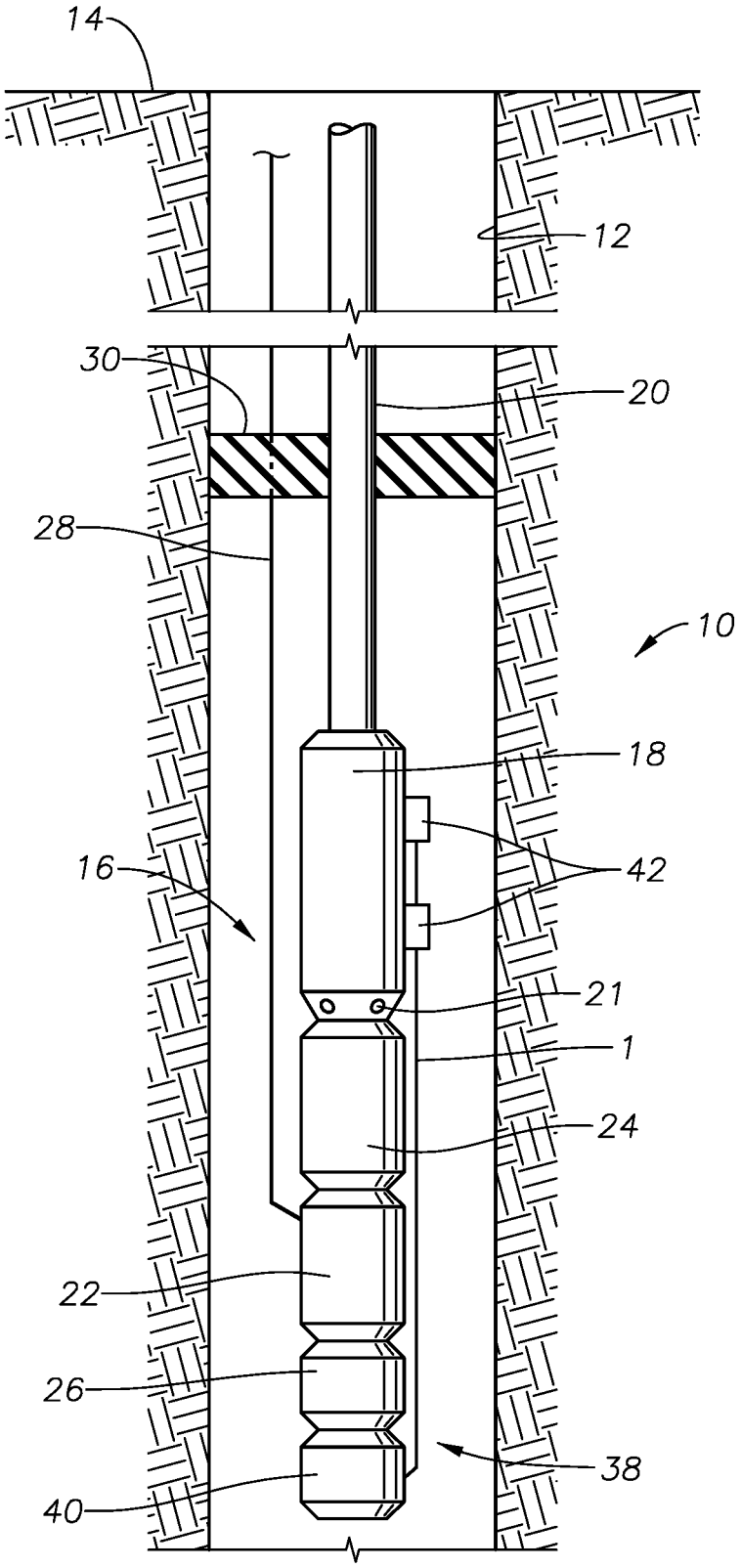
FIG. 1 is a schematic elevation view of an electric submersible pump system with a modular ultrasound assembly in accordance with an embodiment of this disclosure.

Looking at FIG. 1, well 10 can have wellbore 12 that extends to an earth's surface 14. Well 10 can be an offshore well or a land based well and can be used for producing hydrocarbons from subterranean hydrocarbon reservoirs. Submersible pump string 16 can be located within wellbore 12. As is discussed herein, submersible pump string 16 can provide artificial lift to wellbore fluids and has solid buildup removal capabilities. Submersible pump string 16 can be an electrical submersible pump assembly and can include pump 18. Pump 18 can be, for example, a rotary pump such as a centrifugal pump. Pump 18 could alternatively be a progressing cavity pump, which has a helical rotor that rotates within an elastomeric stator or other type of pump known in the art for use with an electrical submersible pump assembly. In the example of FIG. 1, one pump 18 is used and in the example of FIG. 2, two pumps 18 are used. In alternate embodiments, submersible pump string 16 can include more than two pumps 18.

Pump 18 is submerged in the wellbore fluids and in fluid communication with tubular member 20 that extends within wellbore 12 to carry wellbore fluids from downhole to the earth's surface 14. Pump 18 is oriented to boost the pressure of the wellbore fluids traveling from the wellbore towards the earth's surface 14 so that wellbore fluids can travel more efficiently to the earth's surface 14. Pump 18 can include fluid inlets 21 that create a passage for wellbore fluids to enter pump 18 and be conveyed up tubular member 20 to the earth's surface 14.

Submersible pump string 16 includes motor 22 that is also located within wellbore 12 and provides power to pump 18. Looking at FIGS. 1-2, a single motor 22 can be provided for each pump 18. In alternate embodiments, a single motor 22 could provide power to multiple pumps 18. Submersible pump string 16 further includes seal assembly 24 that is located between motor 22 and pump 18, having a first side connected to motor 22 and a second side connected to pump 18. Seal assembly 24 seals wellbore fluid from entry into motor 22. In certain embodiments, sensor 26 can also be a part of submersible pump string 16. Sensor 26 may measure, for example, various pressures, temperatures, and vibrations. Sensor 26 can obtain the measurements and transmit the measured information to the earth's surface 14.

In the example embodiments power cable 28 extends alongside tubular member 20. Power cable 28 extends from the earth's surface 14 and is, connected to motor 22 of submersible pump string 16. Power cable 28 can provide power to run motor 22.

Packer 30 can be used to isolate the upper section of wellbore 12 from the section of wellbore 12 that contains submersible pump string 16. Packer 30 can be, for example, a standard industry seal bore packer.

Figure 3:
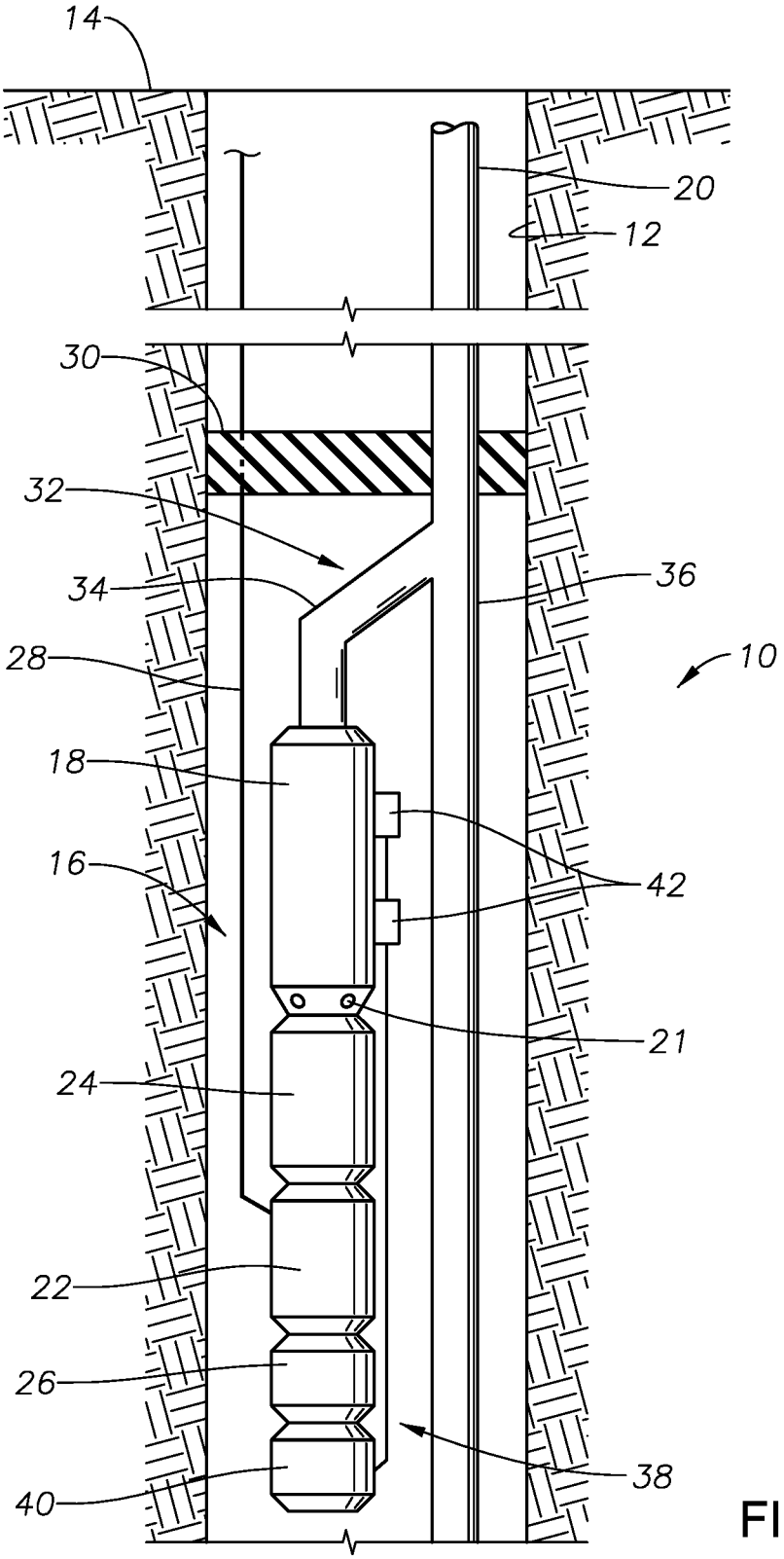
FIG. 3 is a schematic elevation view of an electric submersible pump system with a Y-tool and an ultrasound assembly in accordance with an embodiment of this disclosure.

Turning to FIG. 3, in certain embodiments, Y-tool 32 can have an upper end connected to tubular member 20. First branch 34 of Y-tool 32 can extend downward below packer 30 and be in fluid communication with submersible pump string 16. Second branch 36 of Y-tool 32 can extend downward below packer 30 along side, but not in direct connection with submersible pump string 16. Second branch 36 of Y-tool 32 can therefore be used to provide access to wellbore 12 below packer 30 without going through submersible pump string 16 or having to pull submersible pump string 16.

Figure 2:
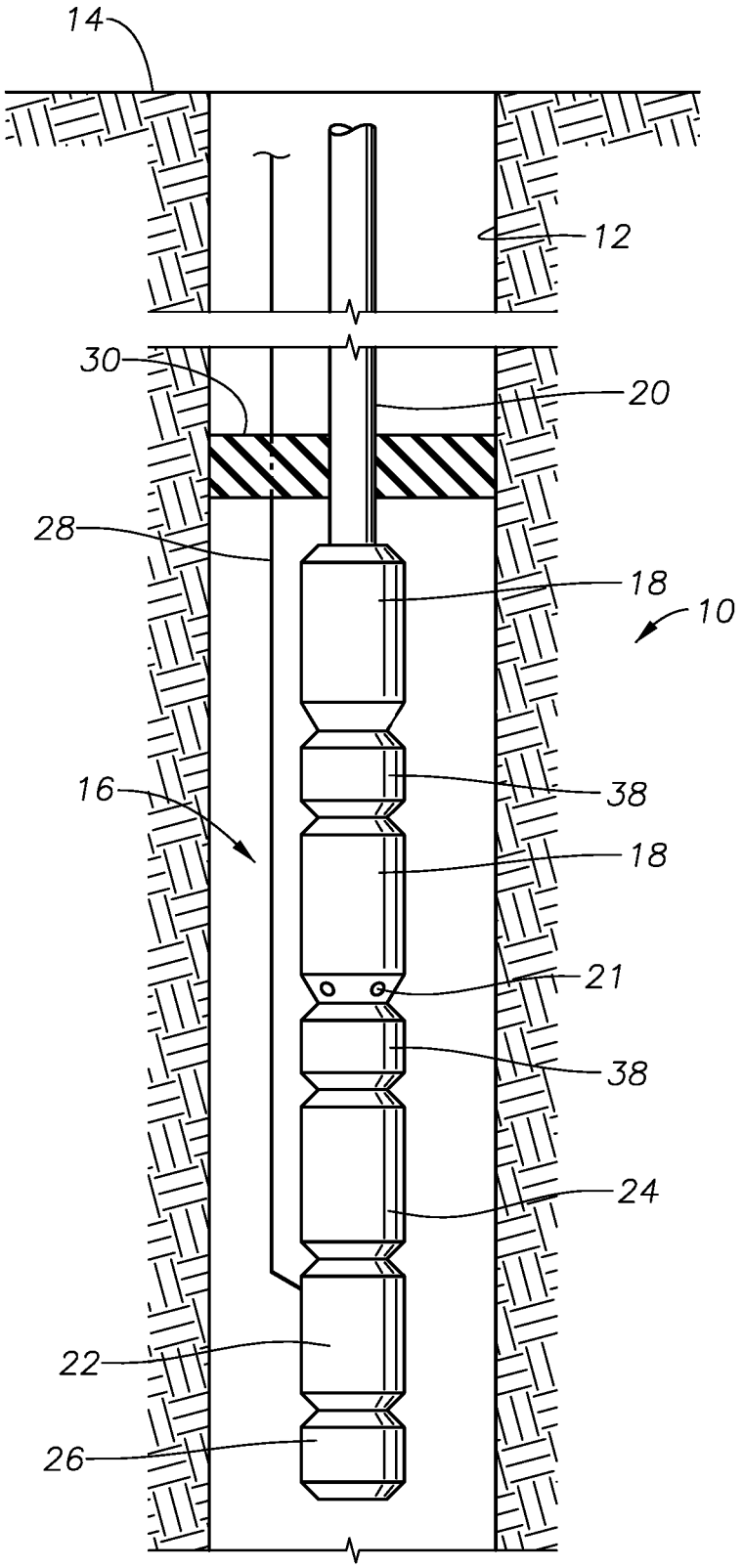
FIG. 2 is a schematic elevation view of an electric submersible pump system with an integrated ultrasound assembly in accordance with an embodiment of this disclosure.

An ultrasonic device 38 can be lowered into wellbore 12 with submersible pump string 16 and be deployed in wellbore 12 when submersible pump string 16 is within wellbore 12. Looking at the example of FIGS. 1 and 3, the ultrasonic device can include ultrasonic generator 40 and ultrasonic transducer 42 that are separate modular components connected at different locations along submersible pump string 16. Looking at the example of FIG. 2, the ultrasonic generator can be a part of ultrasonic device 38 and connected in series with submersible pump string 16, and the ultrasonic transducers can also be located within ultrasonic device 38 or can be located within an internal space of submersible pump string 16. In the example of FIGS. 1-3, ultrasonic generator 40 is connected to submersible pump string 16, ultrasonic transducer 42 is connected to ultrasonic generator 40 so that ultrasonic transducer 42 is in communication with ultrasonic generator 40, and ultrasonic transducer 42 is connected to submersible pump string 16.

Ultrasonic generator 40 generates an electrical pulse that is transmitted to ultrasonic transducer 42. Ultrasonic transducer 42 can be, for example, a piezoelectric element, that vibrates and produces an ultrasound when electric currents are applied. The wall of pump string 16 can transmit the pressure waves. The ultrasound is a vibration that propagates as a mechanical wave of pressure and displacement through the wellbore fluids. Ultrasound is a sound with a frequency higher than 20 KHz, beyond the typical human audible range. The size of the electrical pulses transmitted by ultrasonic generator 40 and delivered to ultrasonic transducer 42 can change the intensity and energy of the ultrasound produced by ultrasonic transducer 42. Ultrasound frequency affects the depth of penetration and other characteristics. In order to vary the ultrasound frequency, multiple ultrasonic transducers 42 each with a different operating frequency can be used, or alternately one ultrasonic transducer 42 capable of producing different frequencies can be used.

In an embodiment of this disclosure one or more ultrasonic generators 40 are located along submersible pump string 16 and each ultrasonic generator 40 is connected to a network of one or more ultrasonic transducers 42 located strategically along submersible pump string 16. Ultrasonic transducers 42 can be secured to an outer diameter of submersible pump string 16 (FIGS. 1 and 3). Alternately, ultrasonic transducers 42 can be located within an internal space of submersible pump string 16.

In alternate embodiments, looking at the example of FIG. 2, ultrasonic device 38 can instead generate high power sound waves by initiating a high voltage electrical discharge between a pair of electrodes of ultrasonic device 38. A high current flows from the anode to cathode, which causes the fluid adjacent to the spark gap to vaporize and form a rapidly expanding plasma gas bubble. These bubbles will continue to expand until the diameter of the bubbles increases beyond the limit sustainable by surface tension, and at which point the bubbles will rapidly collapse, producing the shock wave that propagates through the fluid. The shock wave, in the form of a pressure step function, can generate a high power ultrasound.

In yet other embodiments, ultrasonic device 38 can be magnetostrictive, or can include an electromagnetic acoustic transducer.

Ultrasonic device 38 can be electrically connected to power cable 28 so that power cable 28 provides power to ultrasonic generator 40 or other source of ultrasound of ultrasonic device 38. Alternately, ultrasonic device 38 can be battery powered, utilize inductive coupling, or have dedicated power cable that is separate from power cable 28. In yet other alternate embodiments, ultrasonic device 38 can include a power generator that produces a power supply for ultrasonic device 38 by converting an existing force of energy into a power source for ultrasonic device 38. As an example, ultrasonic device 38 can convert heat within the wellbore, pressure within the wellbore, or vibration within the wellbore to power for use by ultrasonic device 38. The power provided can have a current that is AC, modulated AC, or modulated DC.

Systems and methods disclosed herein can use one or more ultrasonic device 38 that is strategically located along submersible pump string 16 to eliminate or reduce the deposition of crystal seeds in the submersible pump string 16. Ultrasonic device 38 can be oriented to direct the pressure waves within the wellbore fluids, selectively bombarding submersible pump string 16 with ultrasonic cavitation. As an example, pressure waves can be directed towards an intake of pump 18, a stage of pump 18, a discharge of pump 18, an outside of motor 22, Y-tool 32, or a combination thereof.

In certain embodiments, a control system located downhole or at the earth's surface can be in communication with ultrasonic device 38 and can selectively switch ultrasonic device 38 between an operating and non-operating condition as need or in an on-demand basis. In alternate embodiments, ultrasonic device 38 can operate continuously in real-time while submersible pump string 16 is located within wellbore 12.

In certain embodiments, the ultrasonic device 38 operates with a frequency of 20 kHz to 400 kHz. The ultrasound produced by ultrasonic device 38 generates pressure waves that create ultrasonic cavitation where micron-size bubbles form and grow due to alternating positive and negative pressure waves in the wellbore fluids. The bubbles grow until they reach resonant size. Just prior to the bubble implosion, there is a tremendous amount of energy stored inside the bubble, in terms of high pressure and temperature. The implosion of the bubbles, when it occurs near a hard surface, changes the bubble into a jet which travels at high speeds toward the hard surface. With the combination of high pressure, temperature, and velocity, the jet frees contaminants from their attachment to the substrate. In addition, any scale that is formed under the influence of ultrasound can be loose and soft, as compared to dense and hard scale that builds on surfaces of submersible pump string 16 without ultrasound.

A magnitude of scale formation can be dependent on changes in temperature or pressure, although there many are other factors that may trigger scale deposition including turbulence, PH shift, and water incompatibility. One of the mechanisms of scale formation is called homogenous nucleation which entails the development of clusters of atoms or nuclei as a result of an association of ion pairs. The atom clusters form small seed crystals that grow by absorbing additional ions into the imperfections of the crystal structure. Heterogeneous nucleation on the other hand, tends to initiate in nucleation sites that include surface defects, joints and seams. Heterogeneous nucleation is the main mechanism of scale deposition in electrical submersible pumps and downhole equipment in general, however homogenous nucleation may also occur. The size of the crystal affects the speed of scale deposition; the bigger the crystal the faster the growth and conversely smaller crystals may get dissolved.

In an example of operation, in order to provide artificial lift to wellbore fluids and also remove solid buildup to the artificial lift assembly, submersible pump string 16 can be provided with ultrasonic device 38. Ultrasonic deice 38 can direct pressure waves within the wellbore fluids towards elements of submersible pump string 16. In one embodiment, ultrasonic device 30 can include ultrasonic generator 40 and ultrasonic transducer 42, which are connected to submersible pump string 16. Pump 18 can be submerged in wellbore fluids to boost the pressure of the wellbore fluids traveling from wellbore 12 towards the earth's surface 14 through tubular member 20. An electric pulse can be generated with ultrasonic generator 40 and provided to ultrasonic transducer 42.

The pressure waves generated by ultrasonic device 38 can create ultrasonic cavitation where micron-size bubbles form and grow due to alternating positive and negative pressure waves in the wellbore fluids. The bubbles grow until they reach resonant size and the implosion of the bubbles can changes the bubble into a jet which travels at high speeds toward the surfaces of submersible pump string 16 removing and preventing the buildup of scale on the solid surfaces at the solid and liquid interface of elements of submersible pump string 16. The elements removed can be, for example, inorganic matter such as scale and corrosion products and can be located on, for example, an intake, impeller, diffuser, pump housing or motor housing of pump string 16.

System and method described herein can be adapted to work for any type of electrical submersible pump, including rig-less deployed systems. Embodiments of this disclosure allow for an increased time of use of submersible pump string 16 at full capacity, increasing the volume of production of hydrocarbons. In addition, embodiments of this disclosure allow for an increased time of use of submersible pump string 16 before having to maintain or replace submersible pump string 16.

Embodiments of the disclosure described herein, therefore, are well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for providing artificial lift to wellbore fluids having solid buildup removal capabilities, the system comprising:

a pump submerged in the wellbore fluids and in fluid communication with a tubular member extending within a wellbore, the pump oriented to selectively boost a pressure of the wellbore fluids traveling from the wellbore towards an earth's surface;

a motor located within the wellbore providing power to the pump;

a seal assembly having a first side connected to the motor and a second side connected to the pump, wherein the pump, the motor and the seal assembly together form a submersible pump string; and an ultrasonic device connected to the submersible pump string and operable to produce pressure waves directed towards the submersible pump string, selectively bombarding the submersible pump string with ultrasonic cavitation that forms a jet that travels towards surfaces of the submersible pump string.

2. The system according to claim 1, wherein the ultrasonic device includes an ultrasonic generator and an ultrasonic transducer.

3. The system according to claim 2, wherein the ultrasonic transducer is located at one of: within an internal space of the submersible pump string, and secured to an outer diameter of the submersible pump string.

4. The system according to claim 1, wherein the ultrasonic device is connected in series with the submersible pump string.

5. The system according to claim 1, further comprising a Y-tool connected to the submersible pump string, and wherein the ultrasonic transducer is integrated with the pump string on the Y-tool.

6. The system according to claim 1, further comprising a power cable extending from the earth's surface, connected to the submersible pump string, and in electrical connection with the ultrasonic device.

7. The system according to claim 6, wherein the power cable is in electrical connection with the motor.

8. The system according to claim 1, further comprising a power generator connected to the ultrasonic device, the power generator producing a power supply for the ultrasonic device from a source selected from a group consisting of heat within the wellbore, pressure within the wellbore, and vibration within the wellbore.

9. A system for providing artificial lift to wellbore fluids having solid buildup removal capabilities, the system comprising:

a submersible pump string oriented to selectively boost a pressure of the wellbore fluids traveling from a wellbore towards an earth's surface through a tubular member extending within the wellbore, the submersible pump string including:

a pump submerged in the wellbore fluids within the wellbore;

a motor mechanically connected to the pump; and a seal assembly located between the pump and the motor;

an ultrasonic generator connected to the submersible pump string;

an ultrasonic transducer connected to the ultrasonic generator; and wherein the ultrasonic transducer is operable to generate pressure waves within the system, selectively bombarding the submersible pump string with ultrasonic cavitation.

10. The system according to claim 9, wherein the ultrasonic transducer operates with a frequency of 20 kHz to 400 kHz.

11. The system according to claim 9, wherein the ultrasonic transducer includes a network of individual transducers spaced along the submersible pump string.

12. The system according to claim 9, wherein the ultrasonic transducer is oriented to direct the pressure waves towards one selected from a group consisting of an intake of the pump, a stage of the pump, a discharge of the pump, an outside of the motor, a Y-tool, or a combination thereof.

13. The system according to claim 9, further comprising a control system in communication with the ultrasonic generator and selectively switching the ultrasonic generator between an operating and non-operating condition.

14. A method for providing artificial lift to wellbore fluids and solid buildup removal, the method comprising:

providing a pump, a motor for powering the pump, and a seal assembly having a first side connected to the motor and a second side connected to the pump, wherein the pump, the motor and the seal assembly together form a submersible pump string;

connecting an ultrasonic generator and ultrasonic transducer to the submersible pump string;

submerging the pump in the wellbore fluids to boost a pressure of the wellbore fluids traveling from a wellbore towards an earth's surface through a tubular member extending within the wellbore; and generating an electric pulse with the ultrasonic generator, providing the electric pulse to the ultrasonic transducer, and directing pressure waves within the wellbore fluids towards the submersible pump string with the ultrasonic transducer, bombarding the submersible pump string with ultrasonic cavitation and forming a jet that travels towards surfaces of the submersible pump string.

15. The method according to claim 14, wherein the step of connecting the ultrasonic transducer to the submersible pump string includes securing the ultrasonic transducer to an outer diameter of the submersible pump string.

16. The method according to claim 14, wherein the step of connecting the ultrasonic transducer to the submersible pump string includes securing the ultrasonic transducer to an internal space of the submersible pump string.

17. The method according to claim 14, wherein the step of connecting the ultrasonic generator and the ultrasonic transducer to the submersible pump string includes, connecting an ultrasonic device in series with the submersible pump string.

18. The method according to claim 14, wherein the step of directing the pressure waves within the wellbore fluids towards the submersible pump string with the ultrasonic transducer includes directing the pressure waves towards one selected from a group consisting of an intake of the pump, a stage of the pump, a discharge of the pump, an outside of the motor, a Y-tool, or a combination thereof.

19. The method according to claim 14, further comprising producing a power supply for the ultrasonic generator with a power generator that produces power from a source selected from a group consisting of heat within the wellbore, pressure within the wellbore, and vibration within the wellbore.

20. The method according to claim 14, further comprising providing a power to the ultrasonic generator with a power cable that extends from the earth's surface, is connected to the submersible pump string, and is in electrical connection with the ultrasonic generator.

* * * * *